US007124471B2

(12) United States Patent
Koessler

(10) Patent No.: US 7,124,471 B2
(45) Date of Patent: Oct. 24, 2006

(54) HIDDEN HINGE

(75) Inventor: Juergen Koessler, Vancouver (CA)

(73) Assignee: Primex Manufacturing Ltd., Langley (CA)

( * ) Notice: Subject to any disclaimer, the term of this patent is extended or adjusted under 35 U.S.C. 154(b) by 74 days.

(21) Appl. No.: 10/774,504

(22) Filed: Feb. 10, 2004

(65) Prior Publication Data

US 2005/0172452 A1 Aug. 11, 2005

(51) Int. Cl.
*E05D 7/10* (2006.01)

(52) U.S. Cl. ..... 16/267; 16/266; 220/840

(58) Field of Classification Search ..... 16/267–269, 16/355–356, 225, DIG. 13; 220/836, 840–845
See application file for complete search history.

(56) References Cited

U.S. PATENT DOCUMENTS

| | | | | | |
|---|---|---|---|---|---|
| 170,598 | A | | 11/1875 | Shields | |
| 2,347,980 | A | * | 5/1944 | Apfelbaum | 220/844 |
| 2,571,909 | A | * | 10/1951 | Magnenat | 220/844 |
| 2,605,926 | A | * | 8/1952 | Casey | 220/840 |
| 2,677,479 | A | * | 5/1954 | Kiba | 220/840 |
| 2,734,222 | A | * | 2/1956 | Kiba | 220/840 |
| 2,960,254 | A | * | 11/1960 | Kiba | 220/840 |
| 3,126,120 | A | * | 3/1964 | Crate | 220/844 |
| 3,796,780 | A | * | 3/1974 | Schurman | 264/540 |
| 3,803,668 | A | | 4/1974 | Remick | |
| 4,157,600 | A | | 6/1979 | Thomas | |
| 4,448,327 | A | * | 5/1984 | Gahm | 220/840 |
| 4,584,739 | A | | 4/1986 | Konen | |
| 4,724,579 | A | | 2/1988 | Ng | |
| 4,979,264 | A | * | 12/1990 | Ramsauer | 16/264 |
| 4,979,634 | A | * | 12/1990 | Begley | 220/242 |
| 5,048,715 | A | * | 9/1991 | Wolff | 220/832 |
| 5,146,650 | A | * | 9/1992 | Robertson | 16/259 |
| 5,474,200 | A | | 12/1995 | Nicholson | |
| 5,588,182 | A | | 12/1996 | Brownlle et al. | |
| 5,669,106 | A | | 9/1997 | Daoud | |
| 5,711,053 | A | | 1/1998 | Hafner | |
| 5,815,886 | A | | 10/1998 | Nishio et al. | |
| 5,845,366 | A | | 12/1998 | Kuroda | |
| 5,857,738 | A | | 1/1999 | Hamilton | |

FOREIGN PATENT DOCUMENTS

| | | | | |
|---|---|---|---|---|
| DE | 2649205 | A | * | 5/1978 |
| DE | 3542471 | A1 | * | 6/1987 |
| EP | 70611 | A | * | 1/1983 |
| GB | 2071754 | A | * | 9/1981 |
| GB | 2239674 | A | * | 7/1991 |
| GB | 2264105 | A | * | 8/1993 |
| JP | 2001104047 | A | * | 4/2001 |

* cited by examiner

*Primary Examiner*—Chuck Y. Mah
(74) *Attorney, Agent, or Firm*—Oyen Wiggs Green Mutala LLP

(57) ABSTRACT

A hidden hinge structure may be injection molded. The hidden hinge structure has a hinge pin attached to a first part and a hook member that is affixed to a second part. A portion of a frontward one of the first and second parts covers the hinge. The hidden hinge may be used to connect the lid and base of a utility enclosure or housing.

10 Claims, 7 Drawing Sheets

HIDDEN HINGE

TECHNICAL FIELD

The invention relates to plastic hinges. The invention has application, for example, in attaching the lids of utility enclosures. Utility enclosures (or utility boxes) having hinges according to the invention may be used for housing telephone connections, cable television connections, electrical devices or the like.

BACKGROUND

FIG. 1 shows a hinge 10 of a prior art utility box 12. Box 12 has a base 14 attached to a lid 16 by a hinge 10. Base 14 and lid 16 are made of plastic. Hinge 10 is made up of hinge pins 18, which are molded along one edge of base 14, and holders 20 which grasp hinge pins 18. Each holder 20 comprises a clip 22 which projects inwardly from a lip 24 on lid 16. Hinge pins 18 are received in holders 20 between clips 22 and a back surface portion 26 of lid 16.

Hinge 10 is a hidden hinge. Lid 16 covers hinge pins 18 when box 12 is closed. Hiding or covering hinge pins 18 is desirable, because it presents a rugged appearance and may deter unauthorized persons from attempting to open box 12. Box 12 has the disadvantage that it can be opened by pulling lip 24 outwardly as indicated by arrow 27 until clips 22 disengage from hinge pins 18. This is a particular problem where box 12 is made from polypropylene, polyethylene or another soft plastic which will bend significantly upon the application of moderate forces.

FIG. 2 shows a hinge 30 of another prior art utility box 32. Box 32 has a base 34 attached to a lid 36 by hinge 30. Base 34 and lid 36 are injection molded from plastic. Hinge 30 is made up of hinge pins 18, which are molded along one edge of base 34 and hooks 38 which are formed along an edge of lid 36. Hooks 38 extend around hinge pins 18 in a direction from inside to outside.

Hinge 30 has the disadvantage that it is not a hidden hinge. Hinge pins 18 can be seen from the front when box 32 is closed. Unauthorized persons may be tempted to cut hinge pins 18 or otherwise attack exposed hinge 30 to break into box 32.

There is a need for robust cost effective hinges for plastic boxes.

SUMMARY OF THE INVENTION

This invention provides hinges. One aspect of the invention provides a hidden hinge hingedly connecting first and second parts. The hidden hinge comprises a hinge pin attached to the first part; a hook member connected to the second part and hooked around the hinge pin. The hook member has a bight located on a side of the pin away from the second part. A hiding portion of a frontward one of the first and second parts extends in front of the pin. In some embodiments of the invention, an outer portion of the hiding portion extends rearwardly to cover a side of the pin. In some embodiments the hook member is formed integrally with the second part. In other embodiments the hook member is on a piece separate from the second part and is affixed to the second part.

Another aspect of the invention provides a hidden hinge connecting first and second parts. The hidden hinge comprises a hinge pin attached to the first part and a hook member distinct from the second part. The hook member has first and second ends. The hook member comprises a hook on the first end. The hook engages the hinge pin. The second end of the hook member is affixed to the second part. A portion of the second part extends over the hinge pin.

Another aspect of the invention provides a hidden hinge connecting first and second parts. The hidden hinge comprises a hinge pin attached to the first part and a hook member connected to the second part. The hook member comprises a hook engaging the hinge pin. The hinge comprises a flange extending from the first part to cover a front side of the hinge pin. In some embodiments the flange extends outwardly and rearwardly to cover the hinge pin from both front and side directions.

Further aspects of the invention and features of specific embodiments of the invention are described below.

BRIEF DESCRIPTION OF THE DRAWINGS

In drawings which illustrate non-limiting embodiments of the invention.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Various new hinge designs as described herein provide advantages over existing hinges. Some embodiments of the invention provide hidden hinges.

Figure 1:
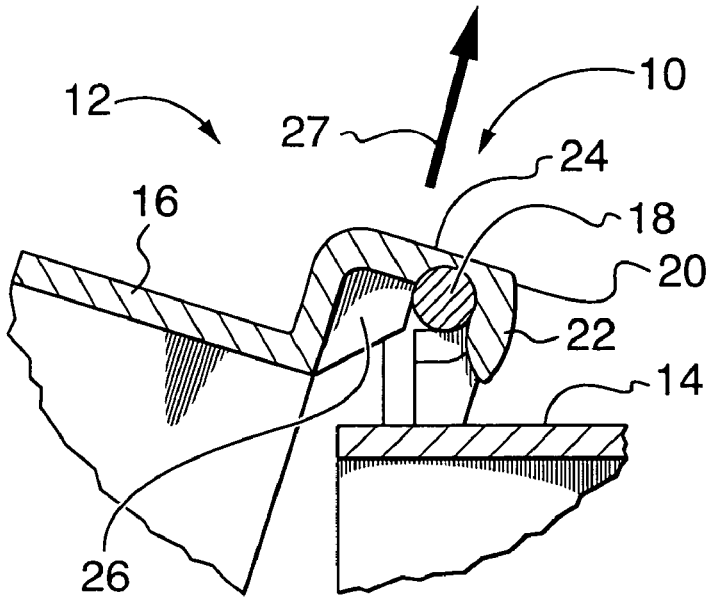
FIG. 1 PRIOR ART
FIG. 1 is a partial cross sectional view through a hinge of a prior art plastic utility box having a hidden hinge.
Figure 2:
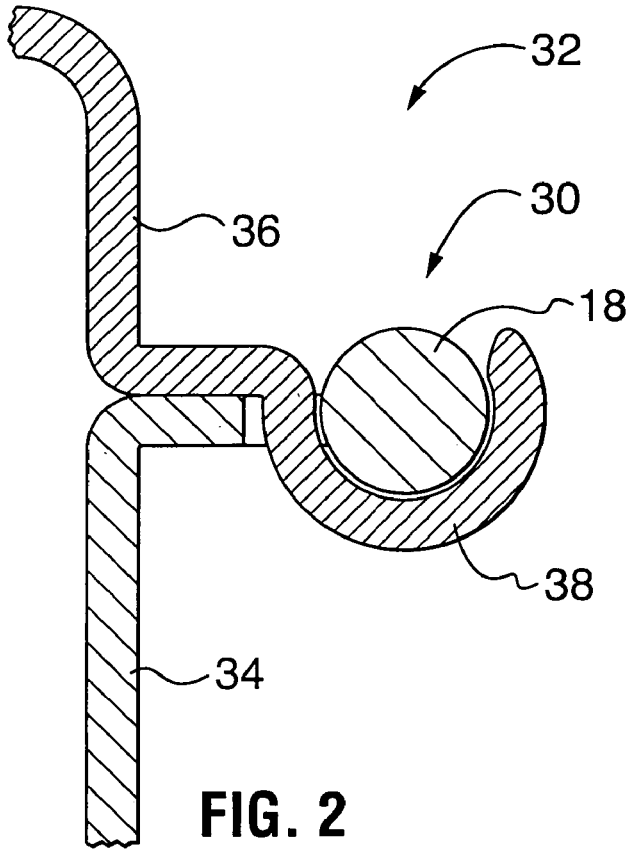
FIG. 2 PRIOR ART
FIG. 2 is a partial cross sectional view through a hinge of a prior art plastic utility box having an alternative hinge.
Figure 3:
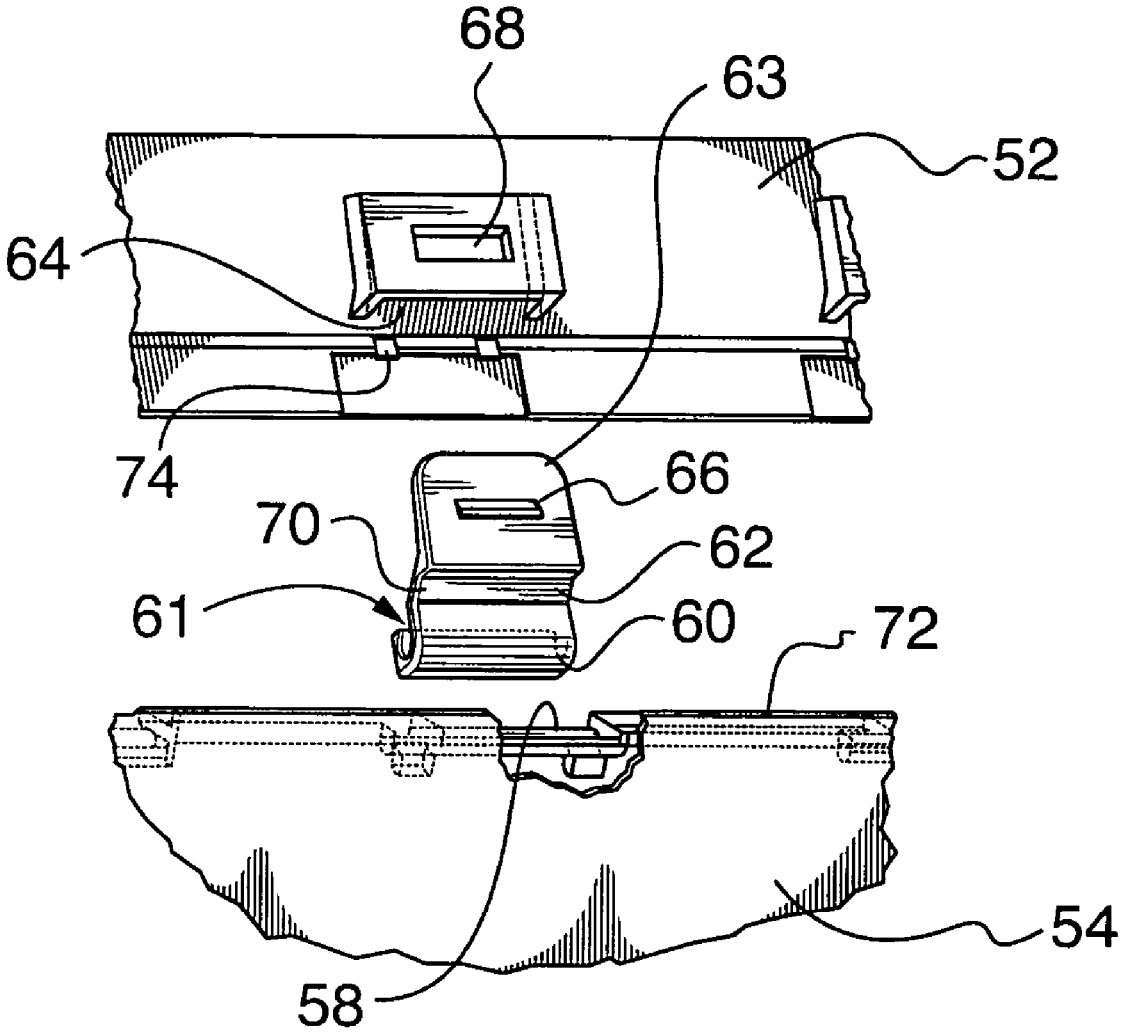
FIG. 3 is a partial exploded and partially cut-away view of a plastic utility box having a hidden hinge according to a particular embodiment of the invention.
Figure 4A:
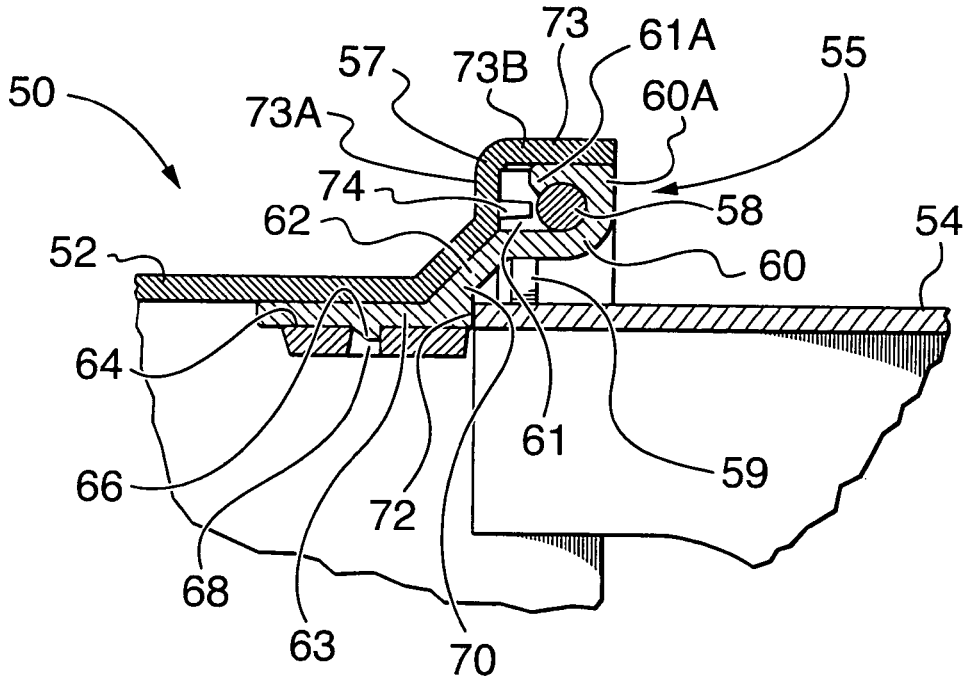
FIG. 4A is a cross section through the FIG. 3 hinge in a closed configuration.
Figure 4B:
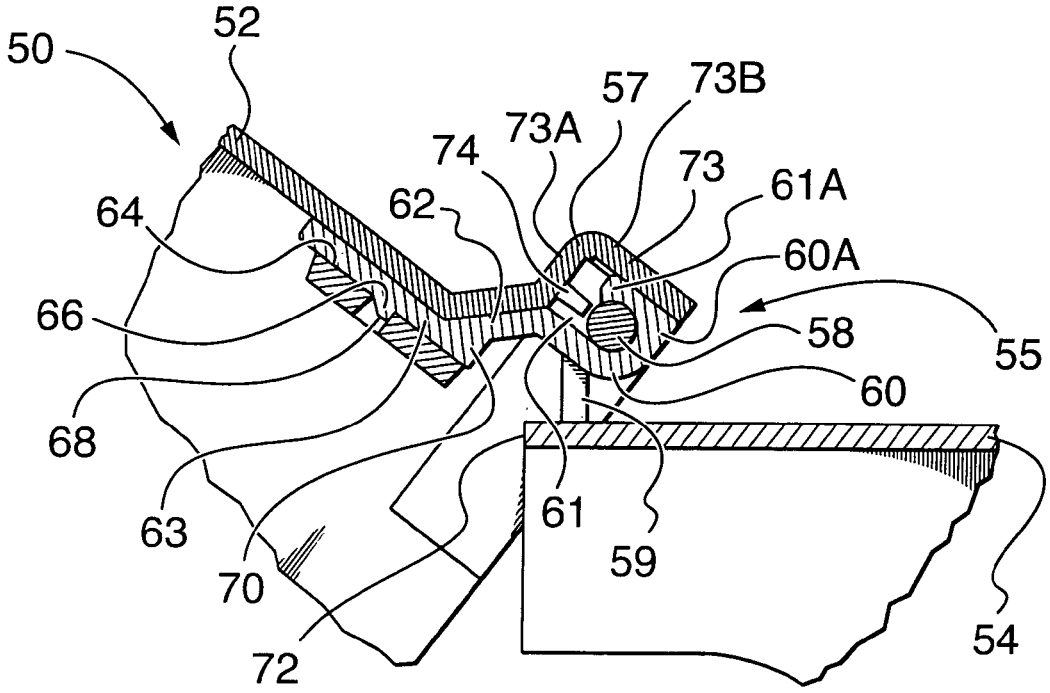
FIG. 4B is a cross section through the FIG. 3 hinge in an open configuration.

FIGS. 3, 4A and 4B show a utility box 50 having a lid 52 attached to a base 54 by a hinge 55 according to a particular embodiment of this invention. Hinge 55 comprises one or more hinge pins 58 attached along an edge of base 54 and hooks 60 which hook around hinge pins 58. A plurality of hinge pins 58 may be axially aligned with one another and molded at spaced-apart locations into a flange 59 projecting outwardly from an edge of base 54.

Hooks 60 wrap around hinge pins 58 in an inside-to-outside direction. Hooks 60 are on separate parts 62 which are attached to lid 52 during assembly of box 50. Hooks 60 have openings 61 to receive hinge pins 58. When box 50 is closed, a bight 60A of each hook 60 is on a side of the corresponding hinge pin 58 that faces away from lid 52. Hooks 60 may include projections 61A on one or both sides of openings 61. Projections 61A snap around hinge pins 58 and help to retain hinge pins 58 engaged in hooks 60.

In the illustrated embodiment, a hook 60 is formed on a first end of part 62 and a second end 63 of part 62 is received in a socket 64 formed in lid 52. When second end 63 is pushed into socket 64, a projection 66 on second end 63 engages an aperture or indentation 68 in an inner wall of socket 64. This causes second end 63 to become affixed within socket 64.

Parts 62 may be affixed to lid 52 by means other than the combination of a projection 66 on a part which engages a socket 64. Parts 62 may also, or in the alternative, be affixed to lid 52 during assembly of box 50 by any other suitable fastening means, for example, projections which engage sockets, screws, rivets, adhesive, plastic welding, or the like, any of which constitute means for affixing hooks 60 to lid 52.

Lid 52 has a portion 57 which extends over hinge pins 58 When box 50 is closed. In the illustrated embodiment, portion 57 is provided by a flange 73 which extends outwardly from a central part of lid 52 in a portion 73A and then curves rearwardly into a portion 73B to cover both front and side aspects of hinge 55 when box 50 is closed.

In the illustrated embodiment, parts 62 have central portions 70 which offset second ends 63 from hooks 60. When box 50 is closed, central portions 70 of parts 62 bear against an edge 72 of base 54.

Box 50 may be assembled by hooking hooks 60 of parts 62 around hinge pins 58 so that second ends 63 of parts 62 project outwardly and central portions 70 bear against and are supported by edge 72; aligning second ends 63 with corresponding sockets 64; and then pressing lid 52 into place until second ends 63 are fully engaged in sockets 64 with projections 66 engaging apertures 68.

After box 50 has been assembled, hinge pins 18 are trapped between hooks 60 and lid portion 57. Pins or other projections 74 may optionally be provided on lid portion 57 to reduce radial play in hinge 55 when hinge 55 is partially or fully open.

Figure 5:
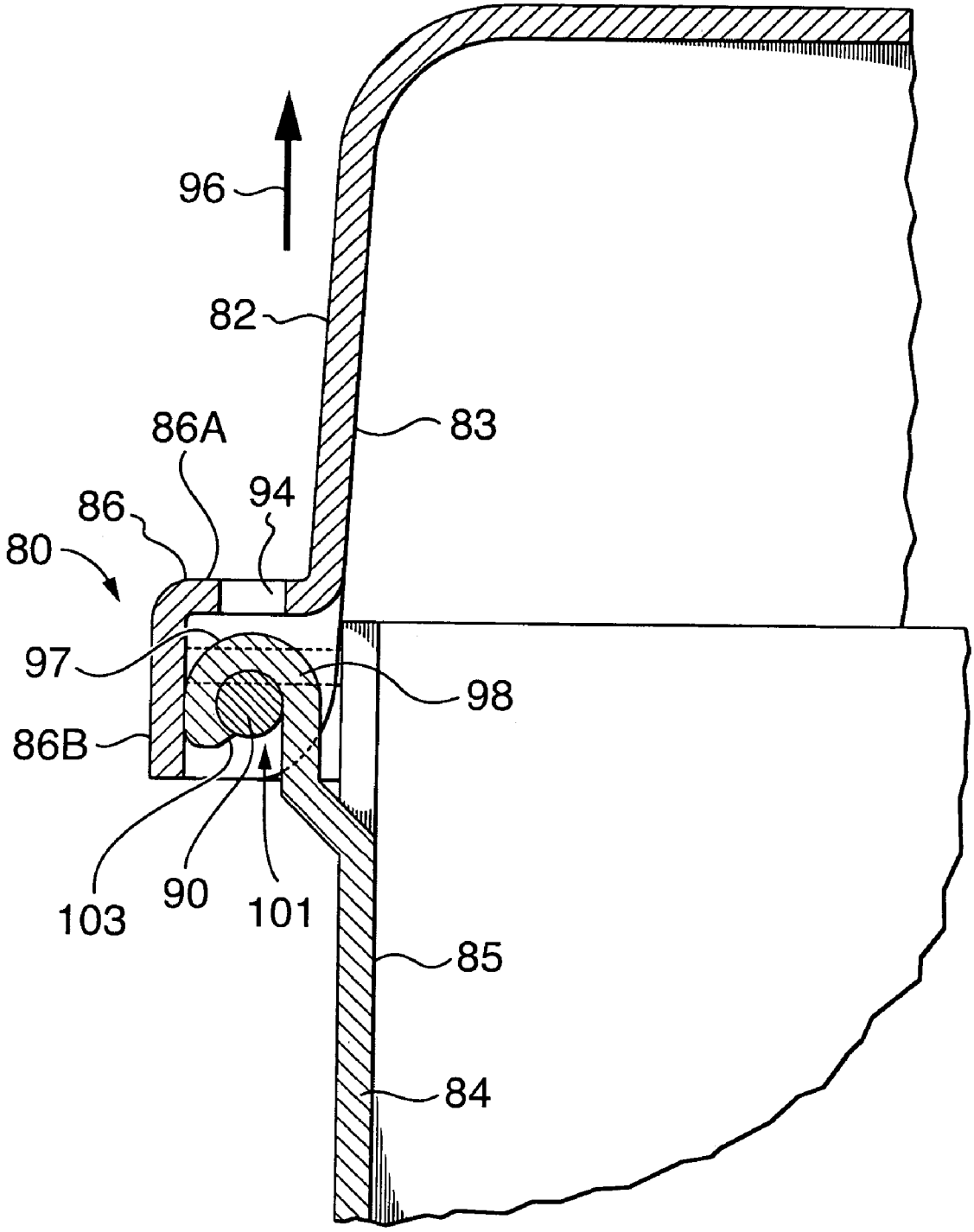
FIG. 5 is a cross section through a hinge according to an alternative embodiment of the invention.
Figure 6A:
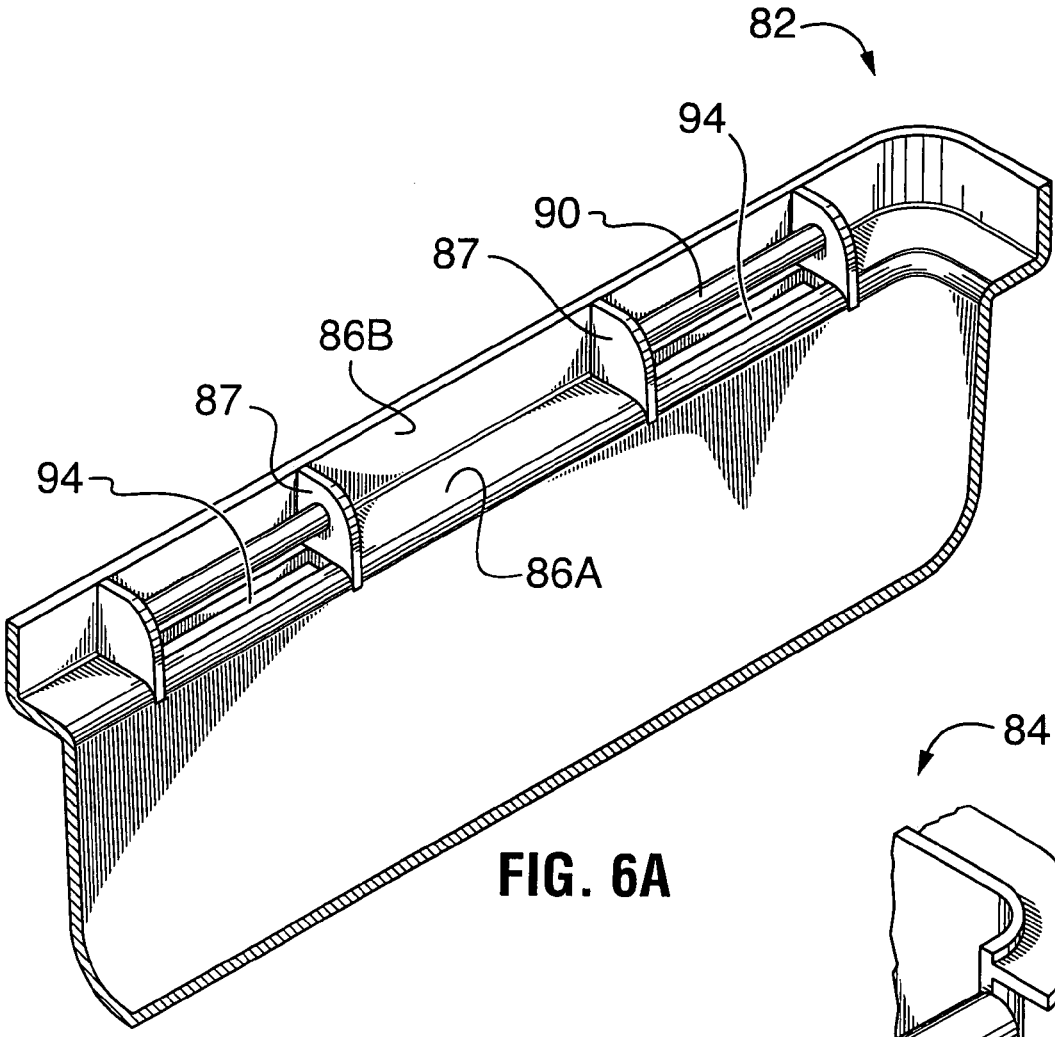
FIG. 6A is a partial isometric view of a first part of a utility enclosure having a hinge as shown in FIG. 5.
Figure 6B:
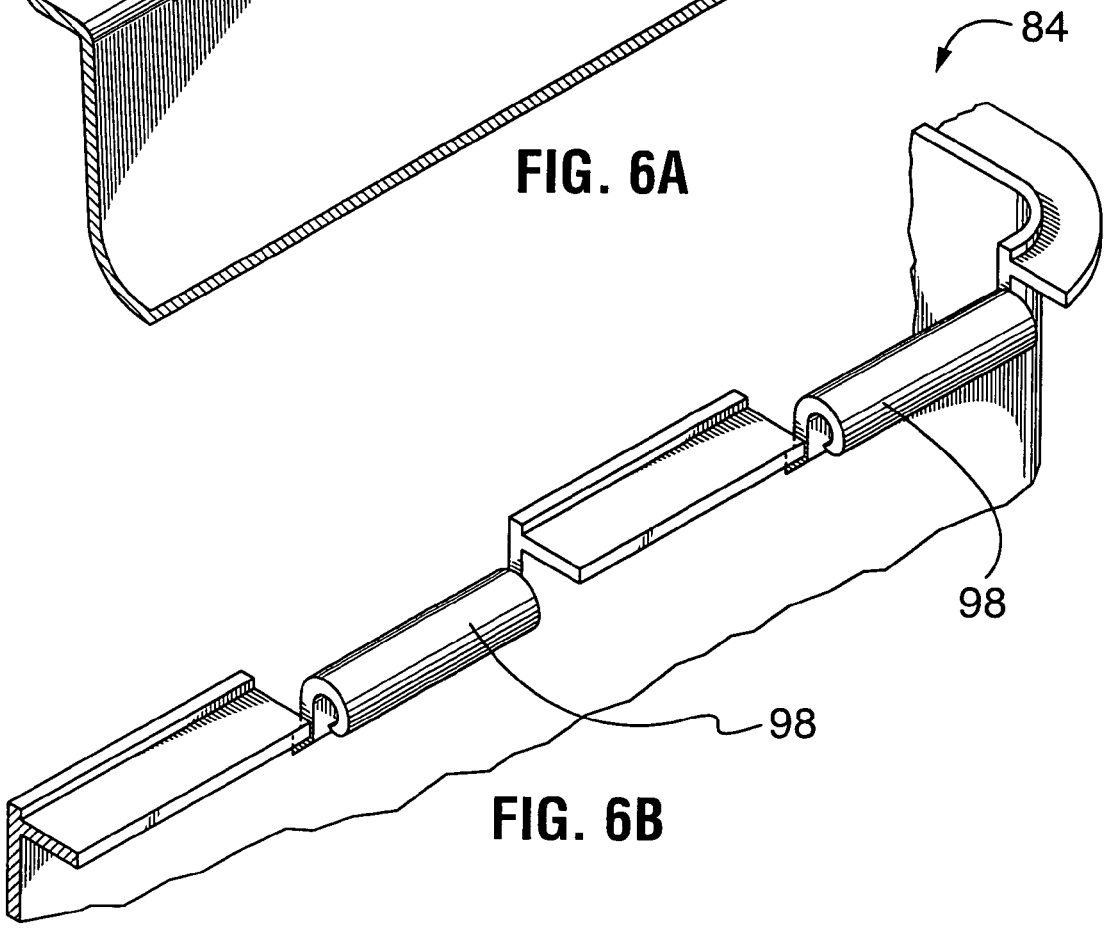
FIG. 6B is a partial isometric view of a second part of a utility enclosure having a hinge as shown in FIG. 5.

FIGS. 5 through 6B show a hinge 80 according to another embodiment of the invention. Hinge 80 hingedly connects a first part 82 with a second part 84. Parts 82 and 84 could for example, be the lid and base of a box or other enclosure. In the illustrated embodiment, a portion 86 of part 82 substantially covers hinge 80. Portion 86 comprises a flange having a front portion 86A which extends over a front-facing part of hinge 80 and a side portion 86B which extends rearwardly to cover hinge 80 from the side.

Hinge pins 90 are attached to part 82. Hinge pins 90 may be formed integrally with part 82 or a portion thereof. In the alternative, hinge pins 90 may comprise separate parts which fit into member 82. For example, in some alternative embodiments hinge pins 90 comprise one or more separate pins pressed longitudinally through holes (not shown) in part 82. FIG. 6A shows one possible arrangement of hinge pins 90 on part 82. In the embodiment of FIG. 6A, hinge pins 90 extend between buttress portions 87.

It may be convenient to fabricate part 82, including hinge pins 90, by an injection molding process. Where this is done, it may be desirable to provide apertures 94 in hiding portion 86 adjacent to hinge pins 90. Apertures 94 can accommodate movable mold sections for use in molding pins 90. Apertures 94 may be left open or may be plugged. Apertures 94, if present, may be in a forward-facing portion 86A of portion 86 or in side portion 86B of portion 86. In either case, hinge 80 is substantially hidden since hinge pins 90 are not exposed from the front or side of hinge 80. Even if apertures 94 are present, hooks 98 prevent hinge pins 90 from being visible through apertures 94.

Figure 7:
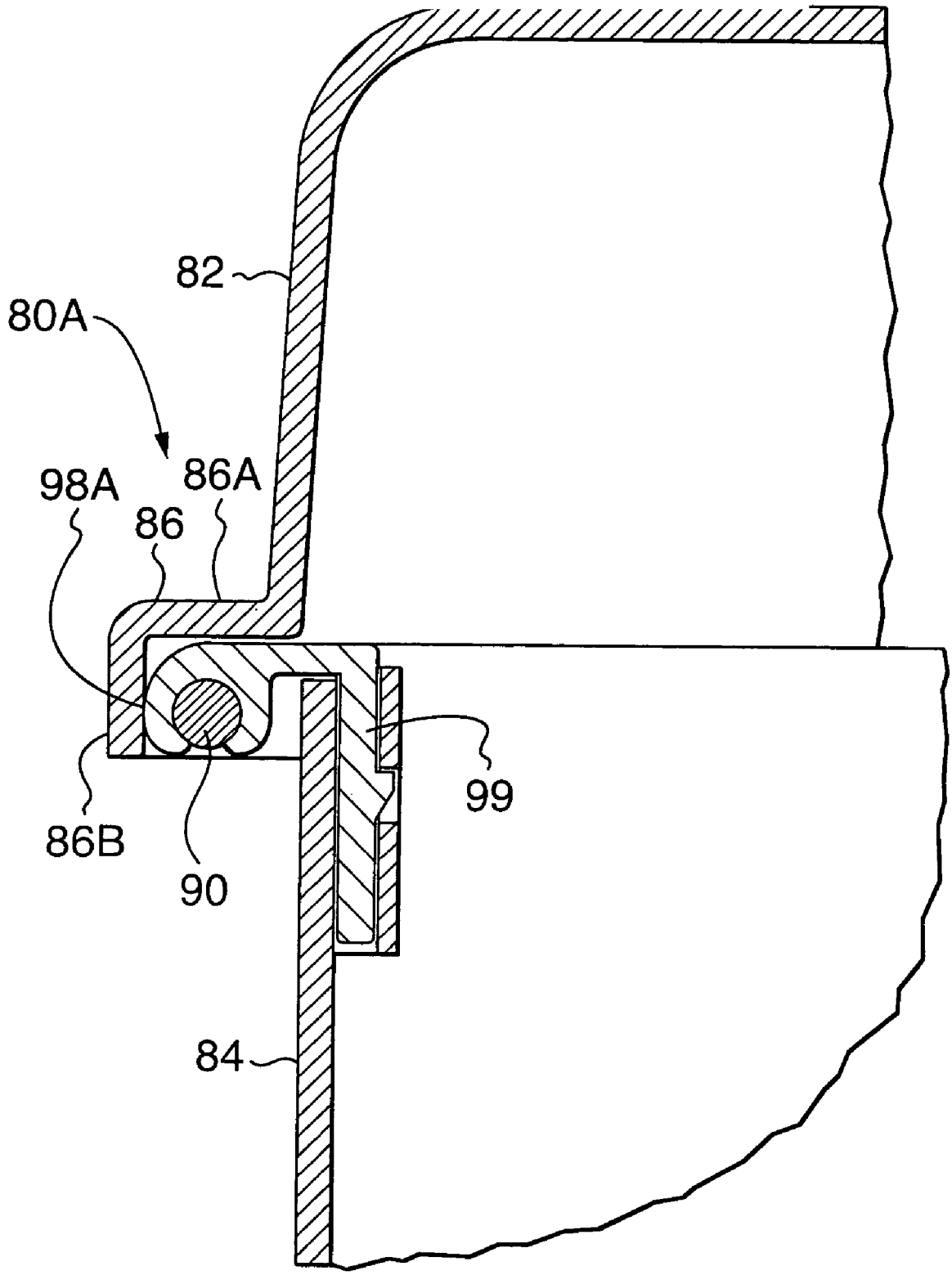
FIG. 7 is a cross section through a hinge according to a further alternative embodiment of the invention; and, FIG. 8 is a cross section through a hinge according to another alternative embodiment of the invention.

In hinge 80, pins 90 are engaged by hooks 98. Hooks 98 may be formed integrally with part 84. For example, FIG. 6B shows a part 84 with integrally molded hooks 98. In the alternative, any suitable attachment means may be provided to attach separate parts which include hooks 98 to part 84. Some suitable attachment means are referred to above in the description of the embodiment illustrated in FIGS. 3 to 4B. FIG. 7 shows a hinge 80A according to an example embodiment of the invention wherein hooks 98A are on separate parts 99 which are affixed to part 84.

In the embodiment of FIG. 5, hooks 98 wrap around the front sides of pins 90 (i.e. around the parts of pins 90 facing toward front part 86A of portion 86). Hooks 98 have openings 101. Part 84 can be hingedly connected to part 82 by inserting pins 90 into openings 101. Preferably openings 101 are slightly narrower than pins 90 so that pins 90 can be snapped into place in hooks 98. In the illustrated embodiment, hooks 98 include projections 103. Projections 103 project into openings 101 and serve to help hold pins 90 engaged in hooks 98.

When hinge 80 is in a closed configuration, the bight 97 of each hook 98 is on a side of the corresponding hinge pin 90 which faces away from the part 84 to which hooks 98 are mounted. It can be seen that pulling on part 82 in the direction of arrow 96 will engage pins 90 more tightly into hooks 98.

Figure 8:
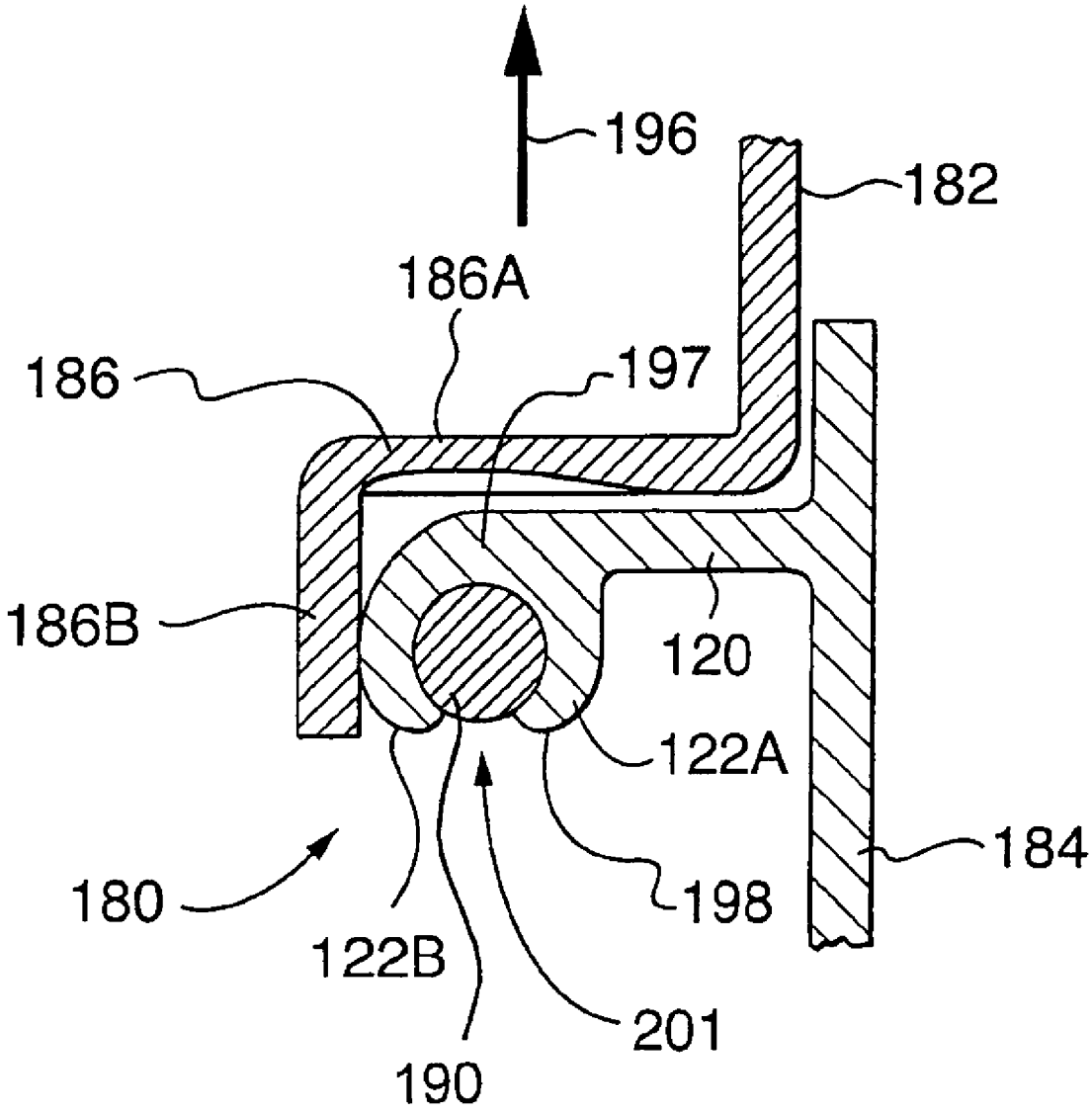

FIG. 8 shows a hinge 180 according to another embodiment of the invention. Hinge 180 hingedly connects a first part 182 with a second part 184. First part 182 is substantially similar to first part 82 of the embodiment illustrated in FIGS. 5 to 6B. Portion 186 of part 182, which comprises a flange having front portion 186A and a side portion 186B, substantially covers hinge 180. Hinge pins 190 are attached to part 182 by any of the techniques referred to above in the description of the embodiment of FIGS. 5 to 6B.

In hinge 180, pins 190 are engaged by hooks 198. Hooks 198 may be formed integrally with part 184. In the alternative, any suitable attachment means may be provided to attach separate parts which include hooks 198 to part 184. In the embodiment of FIG. 8, each hook 198 comprise an arm 120, which extends transversely from part 184 and a pair of clasp members 122A, 122B, which extend rearwardly from arm 120. An opening 201 between clasp members 122A, 122B allows a corresponding hinge pin 190 to be inserted between clasp members 122A, 122B for pivotal movement. Preferably opening 201 is slightly narrower than its corresponding pin 190, so that pin 190 can be snapped into place in hook 198.

When assembled, a bight portion 197 of each hook 198 wraps around the front side of its corresponding pin 190 (i.e. around the part of pin 190 facing toward front part 186A of portion 186). When hinge 180 is in a closed configuration, the bight 197 of each hook 198 is on a side of the corresponding hinge pin 190 which faces away from the part 184 to which hooks 198 are mounted. It can be seen that pulling on part 182 in the direction of arrow 196 will engage pins 190 more tightly into hooks 198.

Hinges according to the invention may be used to connect two parts for which one of the parts is in front of the other in normal use. For example, a utility enclosure may have a base designed to be attached to a wall, ceiling, or the like and a lid intended to be left exposed. In such cases the lid can be considered to be frontward of the base. The base can be considered to be rearward of the lid. In such cases the rear facing aspect of the hinge is shielded from view by the wall or other surface to which the base of the enclosure is intended to be mounted.

In all of the hidden hinges described above, a hinge pin is mounted on a first part and a hook is mounted on a second part. It can be seen that the bight of the hook is located on a side of the pin away from the second part, so that when the hinge is in a closed position, pulling the first and second parts apart tends to pull the hinge pin more firmly into the hook. A hiding portion extends in front of the hinge pin from a frontward one of the first and second parts.

It can be appreciated that an enclosure according to this invention which incorporates a hinge according to any of the arrangements described above can be made such that side walls of the enclosure's base and lid are in general alignment. For example, in the enclosure shown in FIG. 5, side wall 83 of part 82 is in general alignment with side wall 85 of part 84.

Where a component (e.g. an assembly, member, part, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof. For example:

Hinge pins 58 are not necessarily formed integrally with base 54. Hinge pins 58 could be on a separate part which is attached to base 54 in a suitable manner. Hinge pins 58 could be formed of plastic, metal or any other suitable material.

The application of the invention is not limited to utility boxes. Hidden hinges according to the invention may be used to attach lids of enclosures of any kind; to attach lids to other structures; or, in general, to hingedly attach any two parts where a hinge is desired. Hinges according to the invention are particularly advantageous when the parts of the hinge are formed integrally with the parts which are being hingedly connected by the hinge.

Accordingly, the scope of the invention is to be construed in accordance with the substance defined by the following claims.

What is claimed is:

1. A hidden hinge comprising:

a first part and a second part, the first part located generally forwardly of the second part and the second part located generally rearwardly of the first part;

a hinge pin attached to the first part;

a hiding member having a first hiding member portion located forwardly of the hinge pin and extending from a section of the first part located on one transverse side of the hinge pin to an opposing transverse side of the hinge pin and a second hiding member portion which extends rearwardly from the first hiding member portion on the opposing transverse side of the hinge pin and extends from a forward side of the hinge pin to a rearward side of the hinge pin; and a hook member connected to the second part, the hook member hooked around the hinge pin, the hook member extending from a section of the second part located rearwardly of the hinge pin, through a space between the first hiding member portion and the hinge pin, around the hinge pin, and back toward the second part.

2. A hidden hinge according to claim 1 wherein the hook member is formed integrally with the second part.

3. A hidden hinge according to claim 1 wherein the hook member has an opening smaller than a width of the pin such that the pin snaps into place in the opening of the hook member.

4. A hidden hinge according to claim 3 wherein the hook is formed integrally with the second part.

5. A hidden hinge according to claim 3 wherein the hiding member is integrally formed with the first part.

6. A hidden hinge according to claim 5 wherein the hiding member is penetrated by one or more apertures for facilitating injection molding of the hinge pin rearwardly thereof.

7. A hidden hinge according to claim 1 wherein the hiding member is integrally formed with the first part.

8. A hidden hinge according to claim 7 wherein the hiding member is penetrated by one or more apertures for facilitating injection molding of the hinge pin rearwardly thereof.

9. A hidden hinge according to claim 1 wherein the first hiding member portion blocks access to the hinge pin and the hook member from the forward side of the hinge pin.

10. A hidden hinge according to claim 1 wherein the second hiding member portion blocks access to the hinge pin and the hook member from the opposing transverse side of the hinge pin.

* * * * *